US008643570B2

(12) United States Patent
Okamoto et al.

(10) Patent No.: US 8,643,570 B2
(45) Date of Patent: Feb. 4, 2014

(54) ACTIVE MATRIX ORGANIC ELECTROLUMINESCENCE DISPLAY AND ITS GRADATION CONTROL METHOD

(75) Inventors: Kaoru Okamoto, Tokyo (JP); Tadahiko Hirai, Tokyo (JP); Jun Sumioka, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 1018 days.

(21) Appl. No.: 12/145,673

(22) Filed: Jun. 25, 2008

(65) Prior Publication Data

US 2009/0002281 A1 Jan. 1, 2009

(30) Foreign Application Priority Data

Jun. 29, 2007 (JP) ..... 2007-172457

(51) Int. Cl.
*G09G 3/30* (2006.01)

(52) U.S. Cl.
USPC ..... 345/76

(58) Field of Classification Search
USPC ..... 345/76
See application file for complete search history.

(56) References Cited

U.S. PATENT DOCUMENTS

| | | | | |
|---|---|---|---|---|
| 5,114,814 | A | 5/1992 | Sakoh et al. | 430/46 |
| 5,242,773 | A | 9/1993 | Iino et al. | 430/58 |
| 5,242,776 | A | 9/1993 | Doi et al. | 430/67 |
| 2004/0155841 | A1* | 8/2004 | Kasai | 345/76 |
| 2006/0019185 | A1 | 1/2006 | Amamiya et al. | 430/66 |

FOREIGN PATENT DOCUMENTS

| | | |
|---|---|---|
| JP | 52-026226 | 2/1977 |
| JP | 53-092133 | 8/1978 |
| JP | 57-094772 | 6/1982 |
| JP | 02-139566 | 5/1990 |
| JP | 02-150850 | 6/1990 |
| JP | 04-175759 | 6/1992 |
| JP | 05-333757 | 12/1993 |
| JP | 06-148910 | 5/1994 |
| JP | 08-202242 | 8/1996 |
| JP | 2000-056727 | 2/2000 |
| JP | 2001-066814 | 3/2001 |
| JP | 2003-262966 | 9/2003 |

OTHER PUBLICATIONS

Tang et al., "Organic Electroluminescent Diodes," *Appl. Phys. Lett.*, vol. 51, No. 12, 913-915 (1987).

* cited by examiner

*Primary Examiner* — Jonathan Boyd
(74) *Attorney, Agent, or Firm* — Fitzpatrick, Cella, Harper & Scinto

(57) ABSTRACT

An active matrix organic electroluminescence(EL) display comprises plural selection and data lines mutually crossed, and a pixel circuit connected to the selection and data lines and having switching devices, a storage capacitor and an organic EL device. In a part of a period that the pixel circuit connected to the selection line is being selected, an applied first data signal is held as a voltage at the storage capacitor of the selected pixel circuit. After the selection signal applying, a first current according to the held voltage is supplied to the organic EL device, and this emits light at luminance according to the first current. In another part of the period, a second current according to an applied second data signal is supplied to the organic EL device of the selected pixel circuit, and this emits light at luminance according to the second current.

9 Claims, 14 Drawing Sheets

M1; IMPULSE-TYPE DRIVING MODE
M2; HOLD-TYPE DRIVING MODE
M3; RESET MODE

M1; IMPULSE-TYPE DRIVING MODE
M2; HOLD-TYPE DRIVING MODE

ACTIVE MATRIX ORGANIC ELECTROLUMINESCENCE DISPLAY AND ITS GRADATION CONTROL METHOD

BACKGROUND OF THE INVENTION

1. Field of the Invention

The present invention relates to an active matrix organic EL (electroluminescence) display and its gradation control method. In particular, the present invention relates to a driving circuit, a driving method and a gradation control driving method for an active matrix organic EL display.

2. Description of the Related Art

It can be said that, as compared with another type of display, an active matrix organic EL display is excellent in a wide field angle, high speed of response, a thin and light body, and the like.

Incidentally, "Organic Electroluminescent Diodes", C. W. Tang and S. A. Vanslyke, Appl. Phys. Lett. 51, p. 913, 1987 describes the basic device structure of an organic EL device which constitutes the active matrix organic EL display. FIG. 13 indicates the structure of the conventional organic EL device. In FIG. 13, an ITO (indium tin oxide) electrode 202 being a transparent electrode, aromatic diamine 203 being an HTL (hole transport layer), a tris-aluminum complex (Alq3) 204 being an organic emitter layer, and magnesium-aluminum alloy (Mg:Ag) 205 being a cathode are sequentially laminated on a glass substrate 201. Then, light is picked up from the side of the ITO electrode 202 which is transparent in regard to visible light. By the structure of the organic EL device illustrated in FIG. 13, it is possible to emit light at external quantum efficiency 1% or more and luminance 1000 cd/$m^2$ by the driving voltage of 10V or less.

Next, driving systems for causing the organic EL device to emit light will be described.

More specifically, there are two kinds of driving systems for causing the organic EL device to emit light. That is, the driving systems include a passive matrix system and an active matrix system. The passive matrix system is characterized in that the constitution is simple and its manufacturing cost can be made low. In the passive matrix system, a selection line is selected one by one to perform light emission for a pixel. Since the display time of one pixel is constant, the number of the selection lines is in inverse proportion to the light emission time for each selection line. For this reason, in a high-precision device, since the light emission time must be shortened, it is necessary to instantaneously flow a large current to each pixel. This is the serious factor for shortening a lifetime of the organic EL device.

FIG. 14 indicates light emission luminance during one frame period in the passive matrix system. That is, in the one frame period, the period that light emission of the pixel is being performed is only a selection period. As illustrated in FIG. 14, the driving system in which no light emission state occurs until a next video signal is input can be considered as one example of "impulse type driving".

On the other hand, FIG. 15 indicates a basic circuit in the active matrix system. As illustrated in FIG. 15, two kinds of transistors, a switching TFT (thin film transistor) 404 and a driving TFT 405, are provided for each pixel. In the one frame period, during the selection period that a selection line 401 is "high", the switching TFT 404 is "on", and a predetermined voltage is applied to a data line 402, whereby the relative voltage is programmed (set) to a storage capacitor 407. Further, in the one frame period, during the non-selection period that the selection line 401 is "low", the driving TFT 405 is driven according tot he programmed voltage, whereby a current flows from a voltage supply line 403 to an organic EL device 406.

In the above active matrix system, since light emission can be continuously performed even in the non-selection period, maximum luminance for each pixel can be suppressed, whereby reliability increases.

FIG. 16 indicates the light emission luminance during the one frame period in the active matrix system. In the one frame period, light emission of the pixel continuously performed at the light emission luminance programmed in the selection period. As illustrated in FIG. 16, the driving system in which the light emission state is maintained until a next video signal is input is called "hold driving system". In the hold driving system, in addition to a voltage program (voltage setting system) for designating the light emission luminance based on a voltage as illustrated in FIG. 15, a current program (current setting system) for designating the light emission luminance based on a current value is known.

In each of the impulse-type driving and the hold-type driving described as above, the following gradation display is performed.

FIGS. 17A to 17D schematically indicate a gradation display method according to the impulse-type driving. More specifically, FIGS. 17A to 17D indicate a case of designating four gradations, for example, gradation 0 to gradation 3. In such an example, an amplitude value of the voltage or the current to be applied to the organic EL device in each selection period is modulated for each gradation, thereby performing gradation control. Here, to set the more number of gradations, it only has to minutely set the amplitude value of the voltage or the current for each gradation.

Incidentally, Japanese Patent Application Laid-Open No. 2000-056727 discloses a driving apparatus for achieving high gradation by properly combining pulse width modulation and amplitude value modulation.

FIG. 18 indicates an output of the current or the voltage value of the driving apparatus, described in Japanese Patent Application Laid-Open No. 2000-056727, in which the pulse width modulation and the amplitude value modulation are properly combined. In such an example, during an effective scanning period of one horizontal period, that is, during a selection period, a pulse width of a current or voltage value is expressed by four bits and 16 gradation and an amplitude value thereof is expressed by four bits and 16 gradations. Namely, the pulse width and the amplitude value of the current or voltage value are totally expressed by eight bits and 256 gradations. Since four-bit coding in a time direction is performed for 0, 1, 1, 2, 4, 8, instead of usual 0, 1, 2, 4, 8. This is because, since the width of usual coding starts from 0, one LSB unit is added in the time direction.

On the other hand, the gradation display is performed in the hold-type driving as follows.

FIGS. 19A to 19D schematically indicate a gradation display method according to the hold-type driving. More specifically, FIGS. 19A to 19D indicate a case of designating four gradations, for example, gradation 0 to gradation 3. In such an example, the voltage to be applied to the storage capacitor 407 in each selection period is modulated for each gradation to hold a certain voltage at the storage capacitor 407, thereby performing gradation control as maintaining the light emission state even in the non-selection period. Here, to set the more number of gradations in the hold-type driving, it only has to minutely set the voltage of the storage capacitor for each gradation.

In the above examples, light emission is performed only in the selection period in the impulse-type driving, luminance decreases if the number of selection lines is increased for achieving highly precise operation. Further, since it is necessary to instantaneously flow a large current to each pixel in the selection period so as to improve luminance, a lifetime of the organic EL device is shortened. Furthermore, since the selection period shortens if the number of selection lines increases, it becomes difficult to perform pulse width modulation as described in Japanese Patent Application Laid-Open No. 2000-056727.

For example, in a case where the number of selection lines is 1080 and the frame rate is 120 frames/second, if the maximum luminance is set to 500 cd/m$^2$, the maximum light emission luminance of 540000 cd/m$^2$ is necessary for the selection period of each pixel. Further, if the number of selection lines is 1080 and the frame rate is 120 frames/second, the selection period is 7.7 μsec at the maximum. Thus, if the three-bit division is performed as illustrated in FIGS. 7A to 7C, the minimum pulse width comes to be 1 μsec or less. In addition, in regard to the intermediate gradation, there is a case where the current value to which the maximum luminance of 540000 cd/m$^2$ is necessary with the pulse width of 1 μsec or less is output. Accordingly, high output and high-speed operation which are extremely hard to the driver are required.

On the other hand, in regard to the hold-type driving, such a problem of high-speed operation as in the impulse-type driving does not easily occur since the light emission state is maintained even in the non-selection period. However, another problem occurs if the number of gradations increases in the hold-type driving. That is, unlike the impulse-type driving, since the maximum current value or the maximum voltage value is relatively low in case of the maximum luminance of each pixel, the current value of the voltage value in the minimum gradation and a current difference or a voltage difference between the gradations come to be small if the number of gradations increases.

For example, if the current value of one pixel necessary to emit light with the maximum luminance is 10 μA, a minute current such as 150 pA is controlled to achieve a monochromatic color of 16 bits and 65536 gradations defined by a digital video signal interface standard HDMI (High-Definition Multimedia Interface) 1.3. Accordingly, it is extremely difficult to guarantee accuracy of 150 pA in commercially available cost and size to all of a number of DACs (digital-to-analog converters) arranged in a current driver IC.

SUMMARY OF THE INVENTION

The present invention has been completed to solve such problems as described above, and aims to achieve gradation control for an active matrix organic EL display without requiring highly precise modulation of voltage or current amplitude.

To achieve such an object, an active matrix organic EL display is characterized by comprising: plural selection lines (903) and plural data lines (902) which are mutually crossed; and a pixel circuit (901) connected to the selection line and the data line, which includes switching devices (1105, 1106), a storage capacitor (1107) and an organic EL device (1108), wherein, in a part of a period that, by applying a selection signal to one of the plural selection lines (903), the pixel circuit (901) connected to the selection line to which the selection signal is applied is selected, a first data signal is supplied through the data line (902) to the selected pixel and held as a voltage at the storage capacitor (1107) of the selected pixel circuit, and after application of the selection signal to the selection line is ended, a first current according to the voltage held at the storage capacitor (1107) is supplied to the organic EL device, and thus the organic EL device emits light at luminance according to the first current, and wherein in another part of the period that the pixel circuit (901) is being selected, a second current according to a second data signal is supplied through the data line (902) to the organic EL device (1108) of the selected pixel circuit (901), and the organic EL device emits light at luminance according to the second current.

According to the present invention, it is possible to achieve the gradation control of the active matrix organic EL display without requiring highly precise modulation of the voltage or current amplitude.

The present invention is applicable to mobile communication terminals such as a mobile phone and the like and electronic equipments such as a computer, a still camera, a video camera and the like.

Further features of the present invention will become apparent from the following description of the exemplary embodiments with reference to the attached drawings.

DESCRIPTION OF THE EMBODIMENTS

Figure 1:
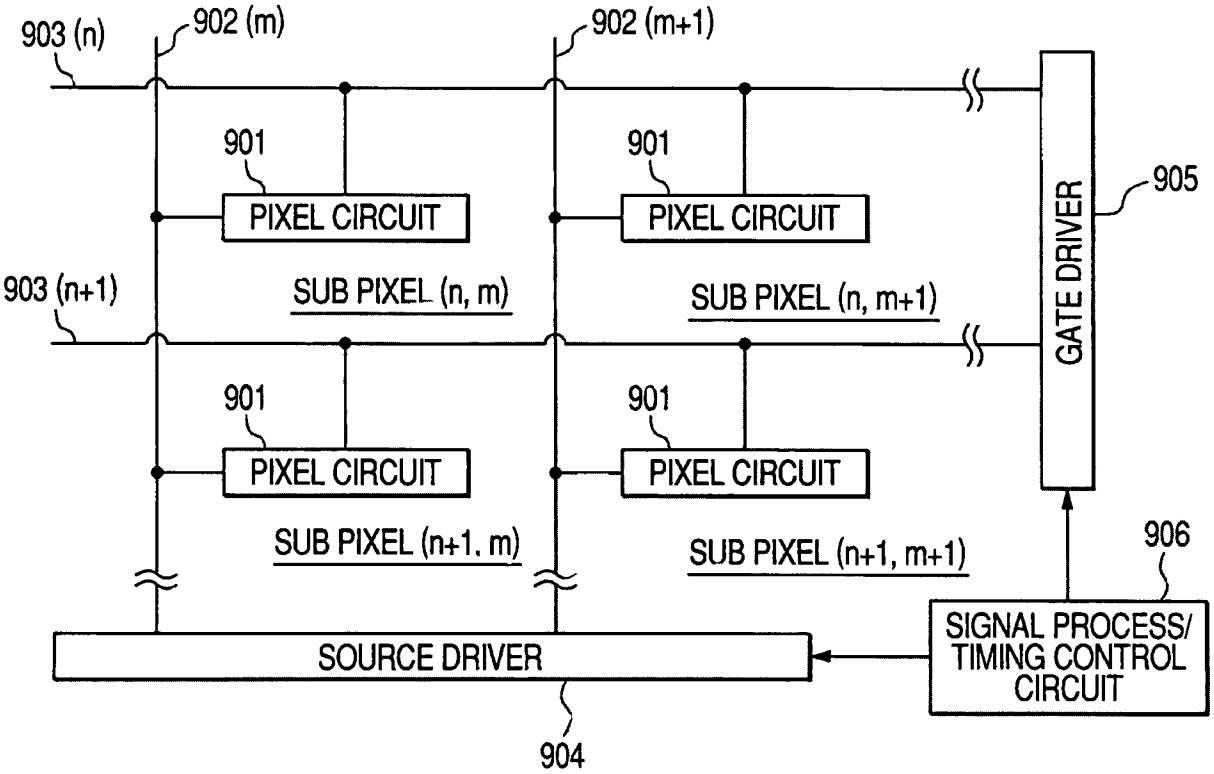
FIG. 1 is a view indicating the system constitution of an active matrix organic EL (electroluminescence) display according to the embodiments of the present invention.

Hereinafter, an active matrix organic EL display according to the present invention and the embodiments of a gradation (gray-scale) control method for the active matrix organic EL display will be described with reference to the attached drawings.

The active matrix organic EL display according to the present embodiment has plural selection lines and plural data lines which are mutually crossed and plural pixel circuits which include switching devices, the storage capacity (capacitors) and organic EL devices. In this gradation control method, both of the following two driving modes are included.

One of the two modes is an "impulse-type driving mode" characterized in that a selection signal is applied to one selection line and a data line is connected with an organic EL device of a selected pixel circuit during a selection period when the pixel circuit is selected and then the light is made to emit by supplying the driving voltage or a driving current from the data line to the organic EL device. In the impulse-type driving mode, the voltage of the selection line becomes a high level and the voltage or a current for driving the organic EL device is supplied via the data line only during a selection period when the switching device for connecting the data line with the organic EL device becomes an ON state and then the organic EL device momentarily emits the light.

Another of the two modes is an ordinary "hold-type driving mode". In the hold-type driving mode, one voltage of the selection line becomes a high level and the voltage or a current for designating the light emission luminance applied to the data line is held as the voltage of the storage capacitor during a period when the switching device for connecting the data line with the storage capacitor becomes an ON state. Then, the driving voltage or the driving current is supplied from a voltage supply line (power supply line) during a non-selection period when the voltage of the selection line became a low level and then the organic EL device emits the light.

In the present embodiment, the light emission luminance (in the present specification, temporally averaged brightness is simply called the luminance, which is distinguished from the momentary luminance in case of temporally varying brightness) of the organic EL device is individually designated in respective modes of the impulse-type driving mode and the hold-type driving mode. That is, different data signals are applied to the data line as the voltage or the current in the respective selection periods and the light is emitted with the respective luminance and then a gradation display is performed by the total luminance. Accordingly, the output accuracy required for a driver in the hold-type driving mode is alleviated, at the same time, the high speed switching required for a driver in the impulse-type driving mode is also alleviated.

The applying of a data signal of the hold-type driving mode (also called a first data signal) and the applying of a data signal of the impulse-type driving mode (also called a second data signal) from the data line can be performed in the time division within the same selection period. In this case, a data signal to be applied to the data line is switched within the one selection period. That is, the (second) data signal of the impulse-type driving mode is applied by using a part period in the selection period and the impulse-type light emission is performed, and the (first) data signal of the hold-type driving mode is applied by using another part period in the selection period and the applied signal is held as the voltage in the storage capacitor. Although the (second) data signal of the impulse-type driving mode and the (first) data signal of the hold-type driving mode within the selection period may be continuously given, it is allowed to provide a pause in the interval. In addition, as long as the charge of the storage capacitor does not vary in operating the impulse-type driving mode, the orders of the impulse-type driving mode and the hold-type driving mode can be changed.

Figure 2:
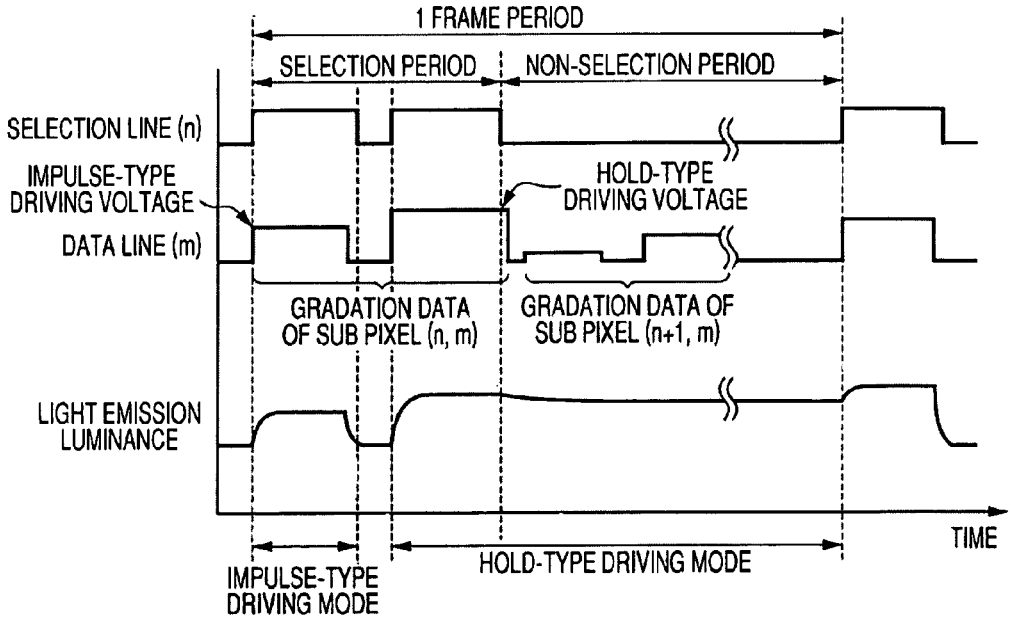
FIG. 2 is a timing chart indicating a gradation (gray-scale) control method of the active matrix organic EL display according to the embodiments of the present invention.

FIGS. 1 and 2 are views for describing a gradation control method of the active matrix organic EL display according to the present embodiment.

FIG. 1 is a constitutional view of the active matrix organic EL display according to the present embodiment. This organic EL display has plural selection lines 903 and plural data lines 902 which are mutually crossed and plural pixel circuits 901. Here, in the plural selection lines 903 and the plural data lines 902, the selection line of n-th line is assumed as a selection line (n) and the data line of m-th row is assumed as a data line (m). In addition, a sub pixel located at a cross point of the selection line (n) and the data line (m) is assumed as a sub pixel (n, m). Each of the selection lines 903 is connected with a gate driver 905 and each of the data lines 902 is connected with a source driver 904. The gate driver 905 and the source driver 904 are connected with a signal process/timing control circuit 906.

FIG. 2 is a timing chart of the voltage of the selection line (n) and the data line (m) to be connected to the sub pixel (n, m) and the light emission luminance of an organic EL device of the sub pixel (n, m).

As illustrated in FIG. 2, one frame period is constituted by a selection period and a non-selection period, and the voltage of the selection line (n) becomes a high level in the selection period and becomes a low level in the non-selection period. The one frame period is constituted by the impulse-type driving mode of emitting light only in the selection period and the hold-type driving mode of emitting light in a part or all of the non-selection period. As illustrated in FIG. 2, a period that the voltage of the selection line (n) within the selection period initially becomes a high level is assumed as the impulse-type driving mode, and a period that the voltage of the selection line (n) within the selection period becomes a high level for the second time and the non-selection period are assumed as the hold-type driving mode.

During the selection period that the voltage of the selection line (n) becomes a high level, gradation data of the sub pixel (n, m) is sent to the data line (m). With respect to the gradation data of the data line (m), the driving voltage for individually designating the light emission luminance is applied at the respective modes of the impulse-type driving mode and the hold-type driving mode. As the driving voltage, two voltages or currents are given, and the one is treated as the impulse-type driving voltage and the other is treated as the hold-type driving voltage for producing the gradation data by use of the both voltages, thereby realizing the multi-gradation without using a high speed driver or a high-accuracy driver.

In the timing chart illustrated in FIG. 2, although there is a period that the voltage of the selection line (n) becomes a low level between the impulse-type driving mode and the hold-type driving mode, this period may be eliminated and the impulse-type driving mode and the hold-type driving mode may be continuously given.

In addition, a reset mode for resetting the voltage held in the pixel circuit to a predetermined value may be included before the impulse-type driving mode or the hold-type driving mode. In the reset mode, the voltage or the current designated at the hold-type driving mode of one frame before is reset by once setting the voltage of the storage capacitor in the pixel circuit to a designated voltage, and it is set to be able to perform the impulse-type driving mode in a new frame.

It is preferable to set the momentary luminance and the time of the impulse-type driving mode in order that the cumulative luminance (the luminance of temporally averaging the momentary luminance) of the impulse-type driving mode at a maximum level becomes nearly equal to the change amount (this is also the minimum luminance) for one step of the gradation of the hold-type driving mode.

In a case that a halftone display of the hold-type driving mode is a halftone display produced by a digital signal, one step of the gradation becomes the discrete luminance. However, by adopting the above method, an interval between one step and one step of the gradation of the hold-type driving mode is covered with the impulse-type driving mode. By generating the intermediate luminance with the impulse-type driving mode, the entire gradation number can be increased by only the corresponded gradation number. And, if the continuous luminance modulation is performed in the impulse-type driving mode, the continuous gradation can be displayed as a whole.

The switching devices may be constituted by TFTs. It is preferable that the TFTs are composed of the amorphous silicon or oxide semiconductors. The TFTs composed of the amorphous silicon are such the TFTs, which use the inexpensive amorphous silicon for channel portions and are suitable as the large number of switching devices to be integrated on a large area. The TFTs composed of the oxide semiconductors are such the TFTs, in which the oxide composed of, for example, elements of Zn, Ga and the like are used for channels, and such the TFTs are easily treated not only in forming the large number of TFTs on a large area inexpensively similar to the amorphous silicon but also in realizing to obtain the high mobility.

In addition, it is preferable to prepare a memory, which stores a value of the driving voltage or the driving current for individually designating the light emission luminance every the gradation, for each of the impulse-type driving mode and the hold-type driving mode. This memory, which is constituted by a ROM (Read Only Memory) or a RAM (Random Access Memory) such as a DRAM (Dynamic Random Access Memory), stores the driving voltage or the driving current, by which the desired light emission luminance can be obtained.

According to the present embodiment, a gradation control of the active matrix organic EL display, especially, a multi-gradation control of a chromatic color of exceeding 10-bit data can be realized without requiring the high-accuracy voltage or the modulation of the current amplitude.

EXAMPLES

Hereinafter, embodiments of the present invention will be described.

First, the first embodiment of the present invention will be described with reference to FIGS. 3 to 7C.

Figure 3:
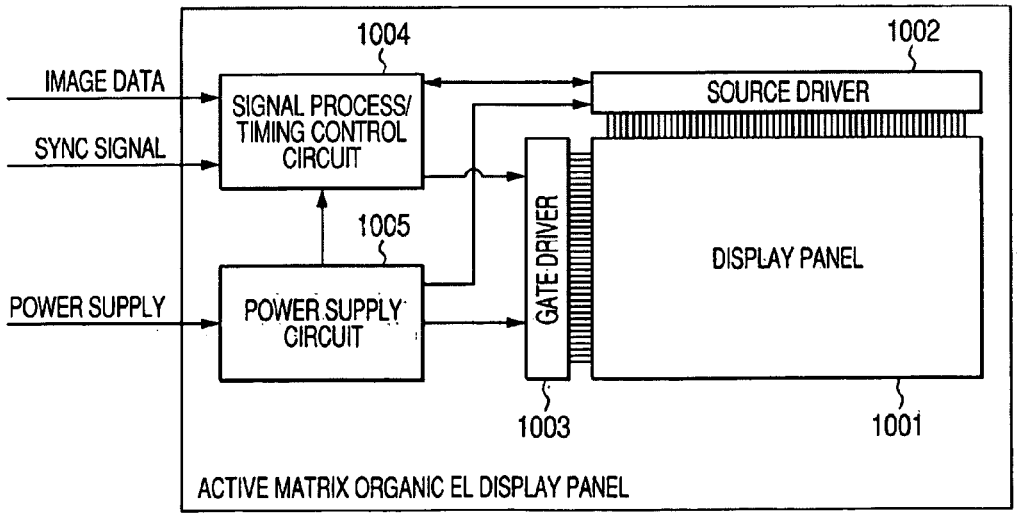
FIG. 3 is a view indicating the panel constitution of an active matrix organic EL display according to the first embodiment of the present invention.

FIG. 3 indicates the system constitution of an active matrix organic EL display according to the present embodiment.

The active matrix organic EL display indicated in FIG. 3 has a display panel 1001, a source driver 1002, a gate driver 1003, a signal process/timing control circuit 1004 and a power supply circuit 1005 as a display panel. As the input to the display panel, there are roughly image data, a synchronous signal thereof and the voltage from an external power supply.

The power is supplied from an external AC (Alternate Current) power supply or an external DC (Direct Current) power supply to the power supply circuit 1005. Then, this power supply circuit 1005 respectively supplies the necessary voltage to the display panel 1001, the source driver 1002, the gate driver 1003 and the signal process/timing control circuit 1004 after performing an AC-DC conversion or a DC-DC conversion.

The signal process/timing control circuit 1004 receives image data and a synchronous signal thereof by using an input interface. As the input interface, the LVDS (Low Voltage Differential Signaling) or the TMDS (Transition Minimized Differential Signaling) can be used. For the image data, data sorting, color correction, gamma correction, a control of black color writing, scaling and the like are performed in a signal processing unit of the signal process/timing control circuit 1004 in order to fit an input form of the driver. Meanwhile, with respect to the synchronous signal, discrimination of an input signal and production of signal timing for the driver are performed in a timing control unit of the signal process/timing control circuit 1004.

The image data and the synchronous signal which were converted for the driver as above mentioned are sent from the signal process/timing control circuit 1004 to the source driver 1002 and the gate driver 1003 through an output interface. As the output interface, the RSDS (Reduced Swing Differential Signaling), the mini-LVDS or the CMOS (Complementary Metal Oxide Semiconductor) can be used.

The source driver 1002 and the gate driver 1003 drive each of the pixel circuits of the display panel 1001 to cause the display panel 1001 to emit the light.

Figure 4:
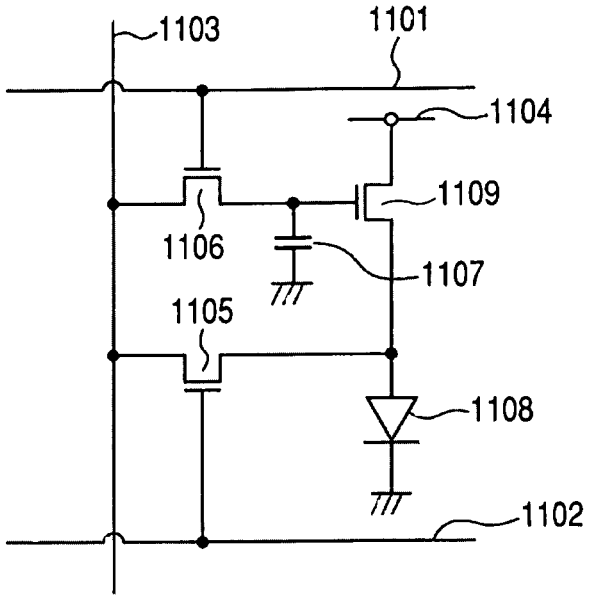
FIG. 4 is a circuit diagram indicating the constitution of a pixel circuit of the active matrix organic EL display according to the first embodiment of the present invention.

FIG. 4 is a view indicating detail of the pixel circuit indicated in FIG. 1.

The pixel circuit indicated in FIG. 4 is connected with a first selection line 1101, a second selection line 1102, a data line 1103 and a voltage supply line 1104. The first selection line 1101 and the second selection line 1102 are connected with the gate driver 1003. The voltage supply line 1104, which is connected with the power supply circuit 1005 through the source driver 1002, supplies a constant voltage to the pixel circuit. Additionally, the data line 1103 is connected with the source driver 1002, from which an image data signal is transmitted to the pixel circuit.

This pixel circuit has a first switching TFT 1106 and a second switching TFT 1105 which are transistors of constituting a switching device, a storage capacitor 1107, an organic EL device 1108 and a driving TFT 1109 which is a driver transistor.

Among the transistors which constitute the switching device, with respect to the first switching TFT 1106, a gate electrode is connected with the first selection line 1101, a drain electrode is connected with the data line 1103 and a source electrode is connected with the driving TFT 1109 and the storage capacitor 1107 respectively. And, with respect to the second switching TFT 1105, a gate electrode is connected with the second selection line 1102, a drain electrode is connected with the data line 1103 and a source electrode is connected with an anode of the organic EL device 1108 respectively.

With respect to the driving TFT 1109, a gate electrode is connected with the source electrode of the first switching TFT 1106, a drain electrode is connected with the voltage supply line 1104 and a source electrode is connected with the anode of the organic EL device 1108 respectively.

The first switching TFT 1106 is a switch for connecting the data line 1103 with the storage capacitor 1107. The storage capacitor 1107 is also connected with the gate electrode of the driving TFT 1109. When a selection signal is entered into the first selection line 1101, the first switching TFT 1106 becomes an ON state, and the voltage of the data line 1103 is set in the storage capacitor 1107. After that time, when the selection period is terminated upon interrupting the selection signal, since the voltage between the gate electrode and the source electrode of the driving TFT 1109 is defined by the voltage of the storage capacitor, a current corresponded to the defined voltage is supplied to the organic EL device 1108. This period corresponds to a hold-type driving mode M2. The second switching TFT 1105 is a switch for connecting the data line 1103 with the organic EL device 1108. When a selection signal is entered into the second selection line 1102, the second switching TFT 1105 becomes an ON state, and then the driving current flows into the organic EL device 1108 by a voltage signal or a current signal of the data line to cause the organic EL device 1108 to emit the light. This period corresponds to an impulse-type driving mode M1.

A reset mode M3 for resetting the voltage held in the pixel circuit to a predetermined value is provided before the impulse-type driving mode M1 and the hold-type driving mode M2.

Figure 5:
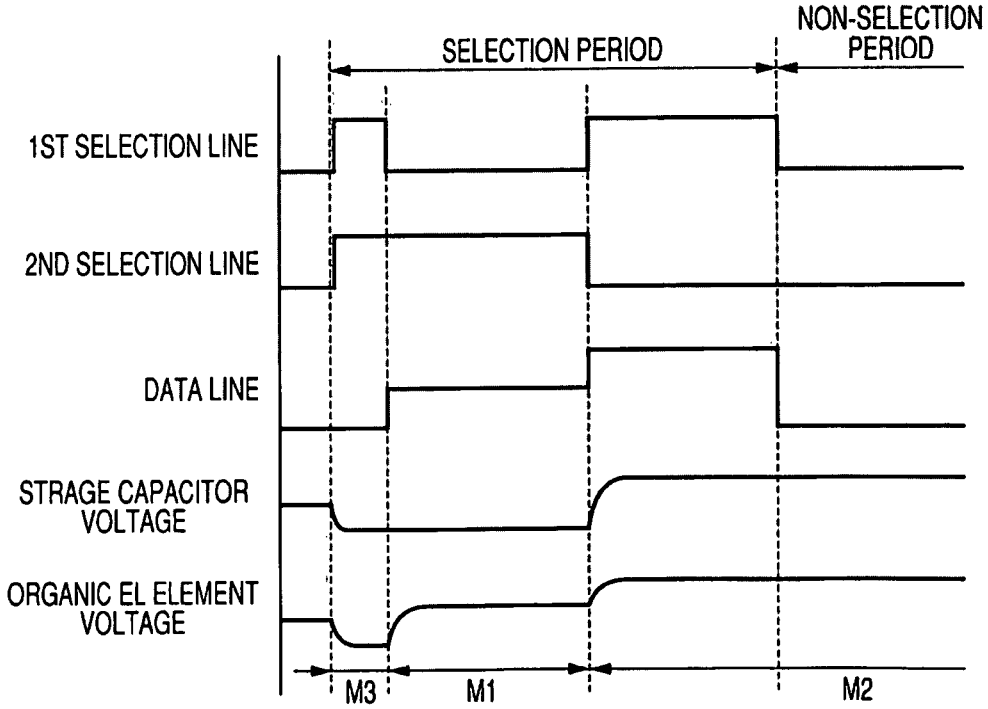
FIG. 5 is a timing chart of a driving method of the active matrix organic EL display according to the first embodiment of the present invention.

FIG. 5 is a timing chart of a driving method of the present embodiment. This timing chart respectively indicates voltages of the first selection line 1101, the second selection line 1102, the data line 1103, the storage capacitor 1107 and the organic EL device 1108 in the selection period of certain one sub-pixel. In the timing chart of this driving method, a gradation program is performed by three steps (modes) of the reset mode M3, the impulse-type driving mode M1 and the hold-type driving mode M2 within the selection period.

First, in a period of the reset mode M3 within the selection period, voltages of the first selection line 1101 and the second selection line 1102 are set to a high level and the first switching TFT 1106 and the second switching TFT 1105 are set to an ON state. At this time, the driving TFT 1109 and the organic EL device 1108 are set to an OFF state by setting the voltage of the data line 1103 to become less than threshold voltages of the driving TFT 1109 and the organic EL device 1108. When the driver FTF 1109 is set to an OFF state, a current from the voltage supply line 1104 is not supplied to the organic EL device 1108.

Next, in a period of the impulse-type driving mode M1 within the selection period, the voltage of the first selection line 1101 is set to a low level and the voltage of the second selection line 1102 is set to a high level, and the first switching TFT 1106 is set to an OFF state and the second switching TFT 1105 is set to an ON state. At this time, the impulse-type driving voltage, which is used to cause the organic EL device to emit the light with the desired luminance, is set for the data line 1103. The impulse-type driving voltage, which was set at this time, is applied to the organic EL device 1108 only the period of the impulse-driving type driving mode M1.

At the last, in a program period of the hold-driving type mode M2 within the selection period, the voltage of the first selection line 1101 is set to a high level and the voltage of the second selection line 1102 is set to a low level, and the first switching TFT 1106 is set to an ON state and the second switching TFT 1105 is set to an OFF state. At this time, the gate voltage, which is used to drive the driving TFT 1109, is set for the data line 1103. Since the set voltage is held in the storage capacitor 1107, the hold-type driving voltage is maintained in the organic EL device 1108 not only a period of the hold-type driving mode M2 but also a non-selection period that the first switching TFT 1106 becomes an OFF state.

Figure 6:
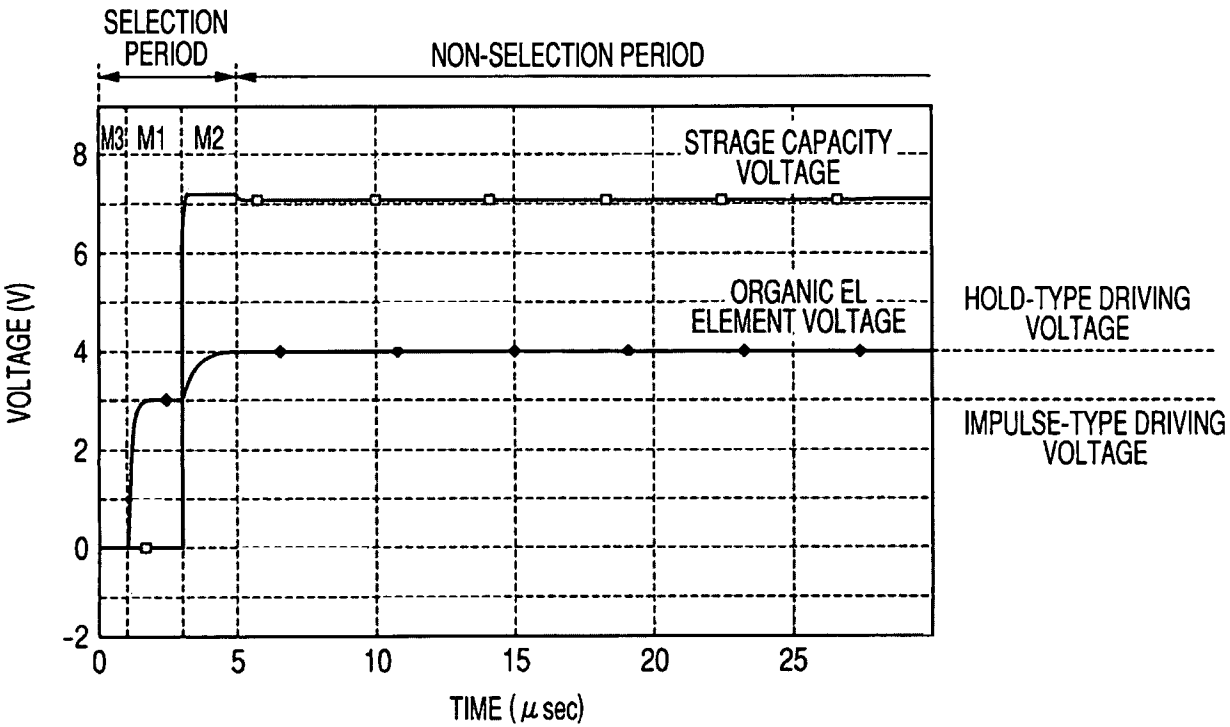
FIG. 6 is a view indicating an SPICE (Simulation Program with Integrated Circuit Emphasis) simulation result of a driving method of the active matrix organic EL display according to the first embodiment of the present invention.

FIG. 6 is a view indicating a result of an SPICE (Simulation Program with Integrated Circuit Emphasis) simulation, which was performed by the above-mentioned constituted pixel circuit and a driving method according to the timing chart. In this simulation, a selection period was set as a period for 5 μsec, and a period of the reset mode M3 was set for 1 μsec, a period of the impulse-type driving mode M1 and a program period of the hold-type driving mode M2 were respectively set for 2 μsec. Both a turn-on time and a turn-off time of signals of the first and second selection lines were set for 0.1 μsec.

As a result of this simulation, it was confirmed that both the voltage of the organic EL device and the voltage of the storage capacitor were reset to 0V in the period of the reset mode M3. In the next period of the impulse-type driving mode M1, the voltage of the organic EL device was set to the impulse-type driving voltage. At the last, in the program period of the hold-type driving mode M2, the voltage of the storage capacitor was set and the hold-type driving voltage was set for the organic EL device. Furthermore, from the result of the above simulation, it was understood that all the steps (modes) were terminated with 5 μsec at a high speed. Accordingly, it was confirmed that if the selection period is 5 μsec, a high speed driving of 180-frame/sec can be realized even if the number of scanning lines is 1080 lines.

From a result of the above-mentioned simulation, it was confirmed that the light is not emitted in the period of the reset mode M3 and the light is emitted with the light emission luminance corresponding to the impulse-type driving voltage in the period of the impulse-type driving mode M1 within the selection period. And, it was confirmed that the light is emitted with the light emission luminance corresponding to the hold-type driving voltage in the program period of the hold-type driving mode M2 and the non-selection period within the selection period.

In the present embodiment, the impulse-type driving voltage and the hold-type driving voltage are individually set, and the set voltages were used for the gradation control. That is, amplitude values of the impulse-type driving voltage and the hold-type driving voltage are respectively divided into 12-bit data equivalent to 4096 steps.

Figure 7A:
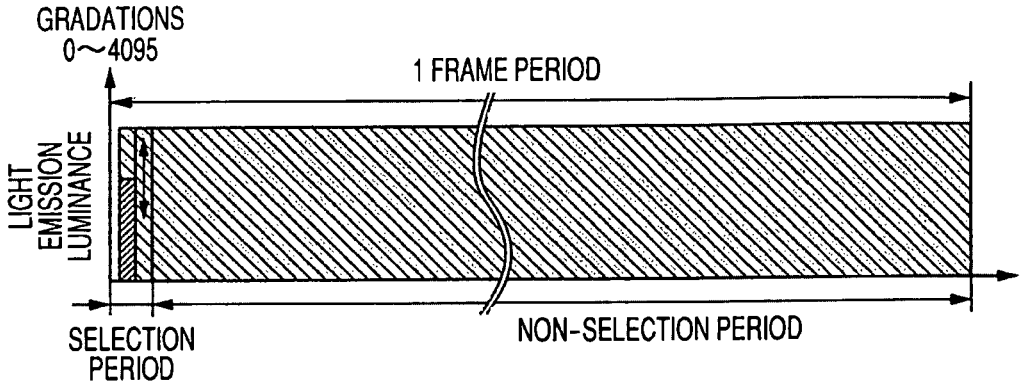
FIGS. 7A, 7B and 7C are views schematically indicating the light emission luminance of a sub pixel when controlling the gradation of the active matrix organic EL display according to the first embodiment of the present invention.
Figure 7B:
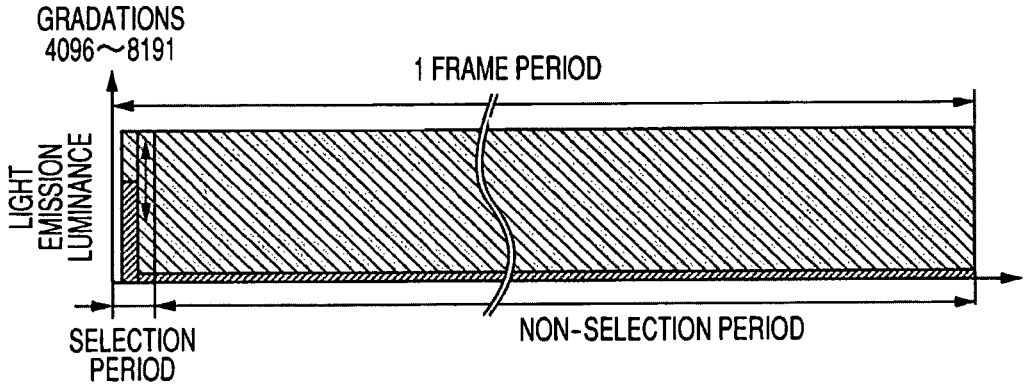
Figure 7C:
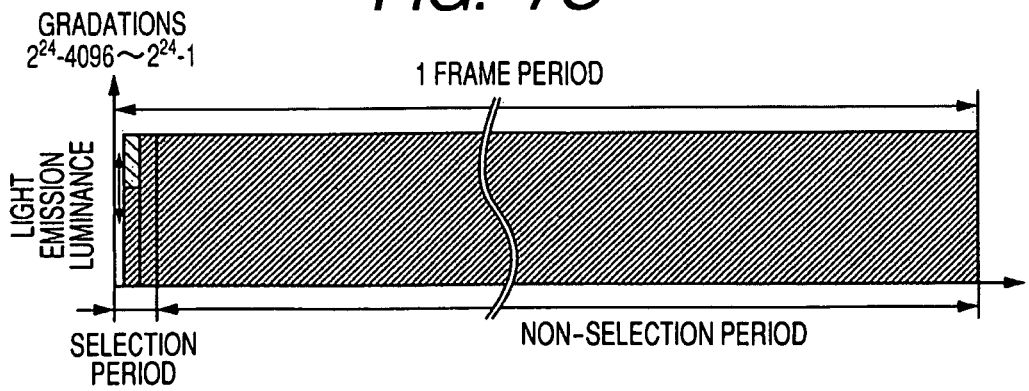

FIGS. 7A to 7C schematically indicate the light emission luminance of a sub pixel when the 24-bit gradation control was performed.

As indicated in FIG. 7A, the hold-type driving voltage is set to such the voltage, by which the organic EL device does not emit the light, at gradations of 0 to 4095, and the 12-bit amplitude modulation is performed to only the impulse-type driving voltage.

As indicated in FIG. 7B, at gradation of 4096, the hold-type driving voltage is set to such the voltage of generating the light emission luminance corresponding to 1/4096-step of gradation and the impulse-type driving voltage is set to such the voltage, by which the organic EL device does not emit the light. And, at gradations of 4096 to 8191, the amplitude modulation is performed to the impulse-type driving voltage while setting the hold-type driving voltage to such the voltage of generating the light emission luminance corresponding to 1/4096-step of gradation.

In this manner, every time when an amplitude value of the impulse-type driving voltage becomes the maximum amplitude value, the hold-type driving voltage is raised one step by one step every the voltage of generating the light emission luminance corresponding to 1/4096-step of gradation. As indicated in FIG. 7C, finally, at gradations of $2^{24}-4096$ to $2^{24}-1$, the amplitude modulation is performed to the impulse-type driving voltage by setting the amplitude value of the hold-type driving voltage as the maximum amplitude value. In other words, the least significant bit (LSB) of the gradation is set by the impulse-type driving voltage and the upper bit is controlled by the hold-type driving voltage.

In the present embodiment, since a display screen is driven under the condition that the number of scan lines is 1080 lines and the frame transmission speed is 120 frames/sec, in a case that the hold-type driving voltage is set to such the voltage of generating the light emission luminance (the minimum light emission luminance) corresponding to 1/4096-step of gradation, the cumulative luminance in a case that the light is made to be emitted by the maximum amplitude voltage in the impulse-type driving mode becomes similar to that of the hold-type driving mode. That is, if the maximum light emission luminance is assumed as 410 cd/m$^2$, the cumulative luminance of the maximum light emission luminance in one frame period of the impulse-type driving mode is 410 cd/m$^2$×2 μsec=820 cd·μsec/m$^2$. On the other hand, in the hold-type driving mode, since the luminance of 0.1 cd/m$^2$ corresponding to 1/4096-step of gradation is set and the light is emitted for 8.2 msec in one frame period, the cumulative luminance of the minimum light emission luminance in the one frame period becomes 0.1 cd/m$^2$×8200 μsec=820 cd·μsec/m$^2$.

In this manner, the multi-gradation can be represented while maintaining continuity of the gradation by setting to the luminance corresponding to the least significant bit of the gradation in the impulse-type driving mode.

As described above in detail, if the pixel circuit and a gradation control method of the present embodiment are used, a monochromatic 24-bit gradation control can be performed without requiring the high speed driving of the driver as in the conventional art or a high output of reducing an operating life of the organic EL device.

Comparative Example

In order to compare with the above-mentioned embodiment, a case that the above-mentioned pixel circuit is driven by only the hold-type driving mode will be mentioned. As compared with the pixel circuit in the present embodiment indicated in FIG. 4, in a case that the impulse-type driving mode is not set, since a second switching TFT is not used, performance of the pixel circuit becomes equivalent to that in the related background art in FIG. 15.

Figure 15:
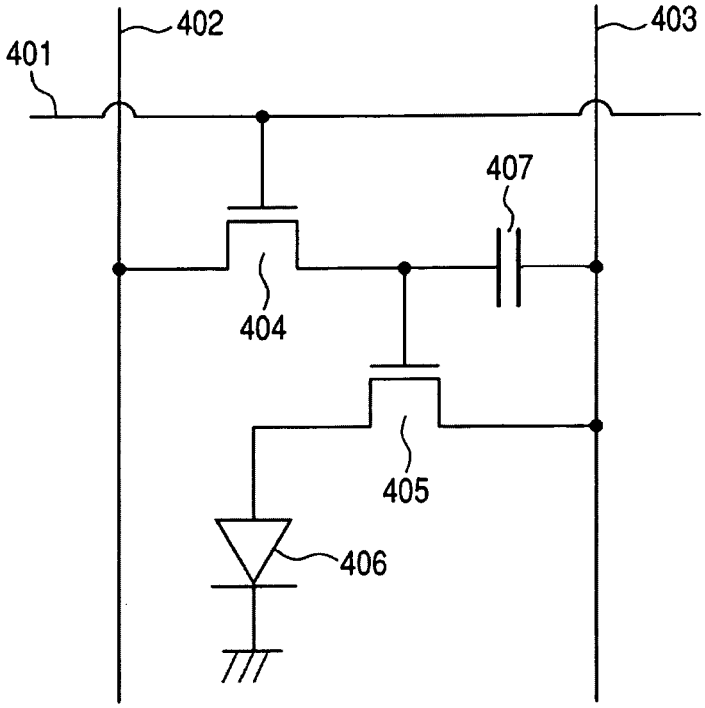
FIG. 15 is a view indicating a basic circuit in a conventional active matrix system.
Figure 16:
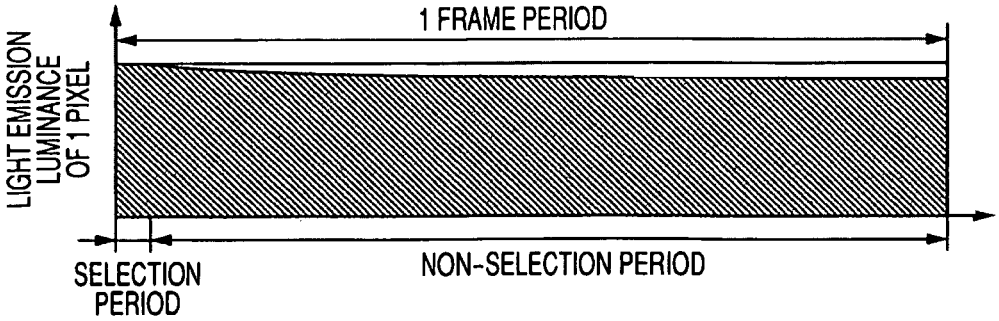
FIG. 16 is a view indicating the light emission luminance during one frame period in the conventional active matrix system.
Figure 17A:
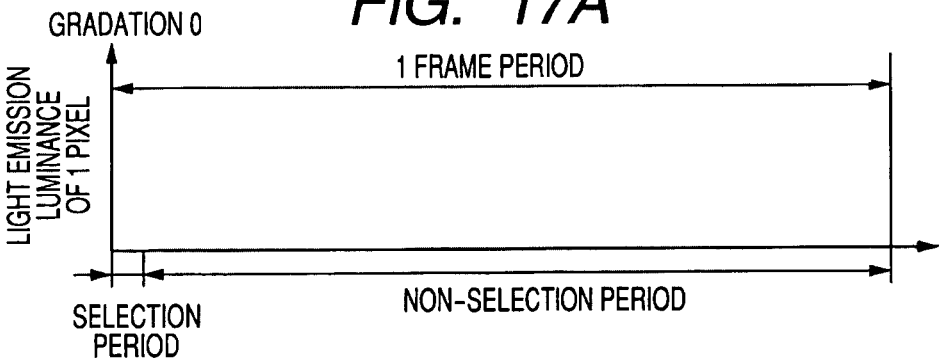
FIGS. 17A, 17B, 17C and 17D are views schematically indicating a gradation display method according to a conventional impulse-type driving.
Figure 17B:
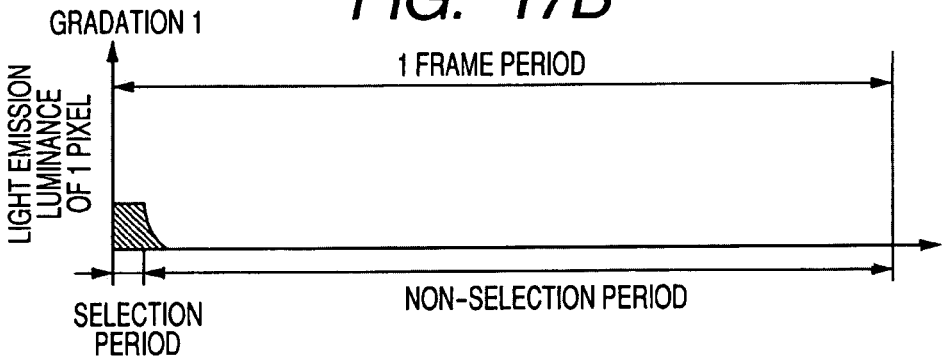
Figure 17C:
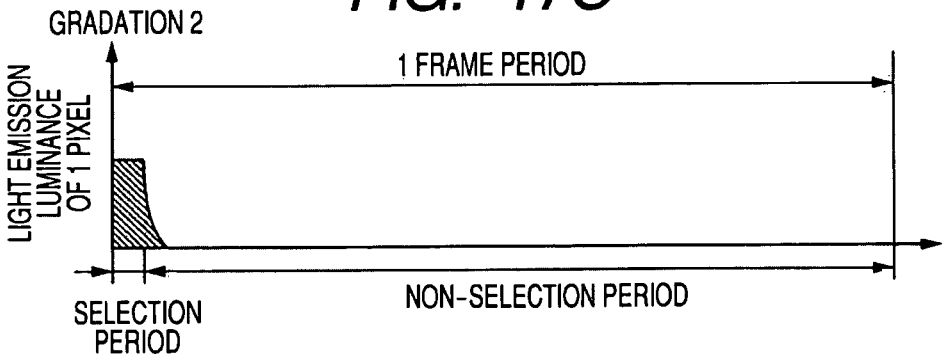
Figure 17D:
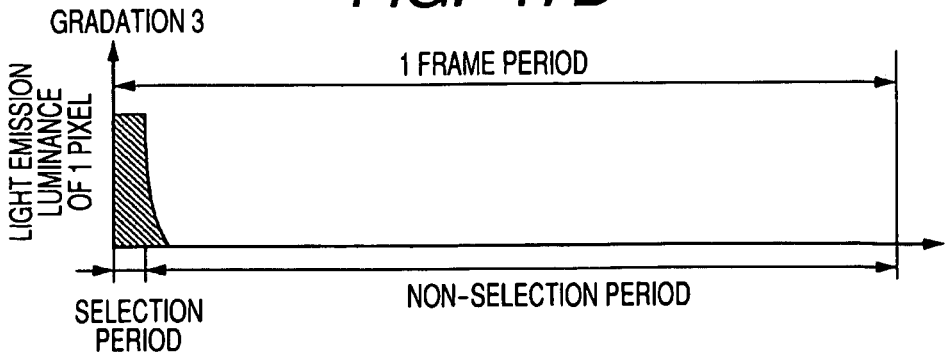
Figure 18:
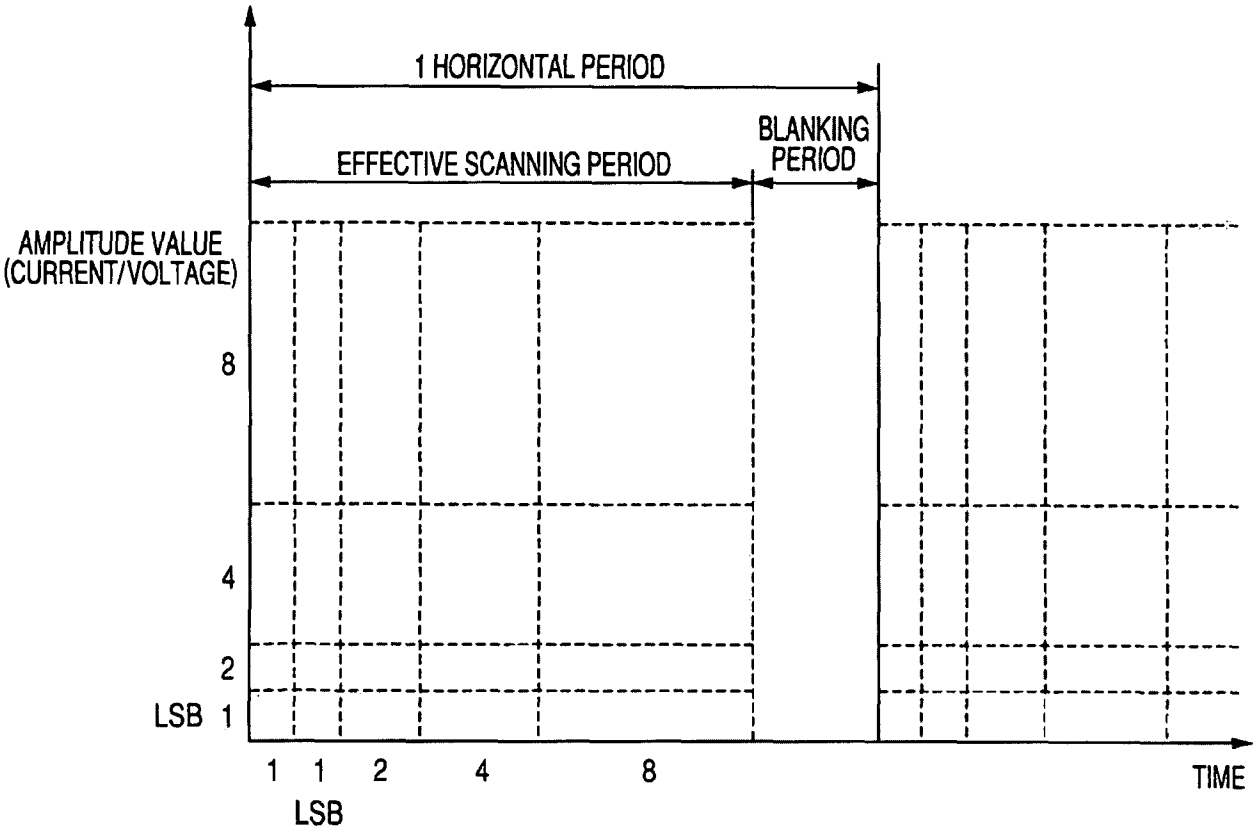
FIG. 18 is a view indicating an output of a current or voltage of a conventional driving apparatus in which pulse width modulation and amplitude value modulation are combined.
Figure 19A:
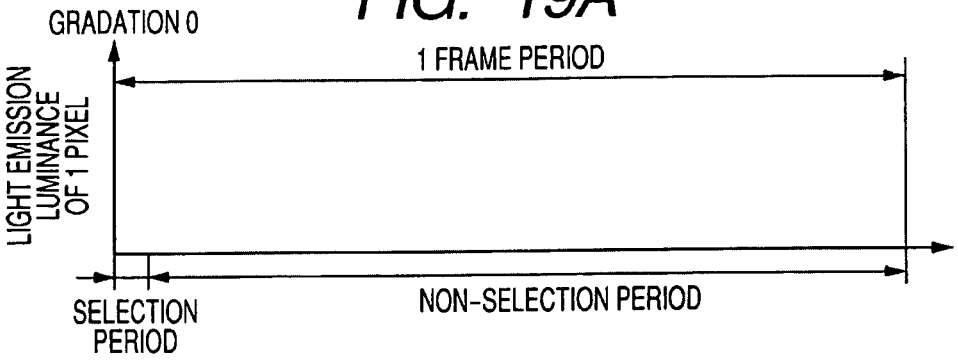
FIGS. 19A, 19B, 19C and 19D are views schematically indicating a gradation display method according to a conventional hold-type driving.
Figure 19B:
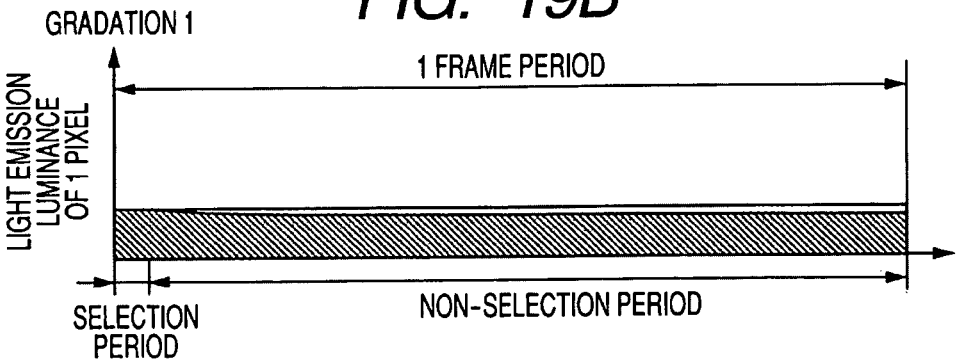
Figure 19C:
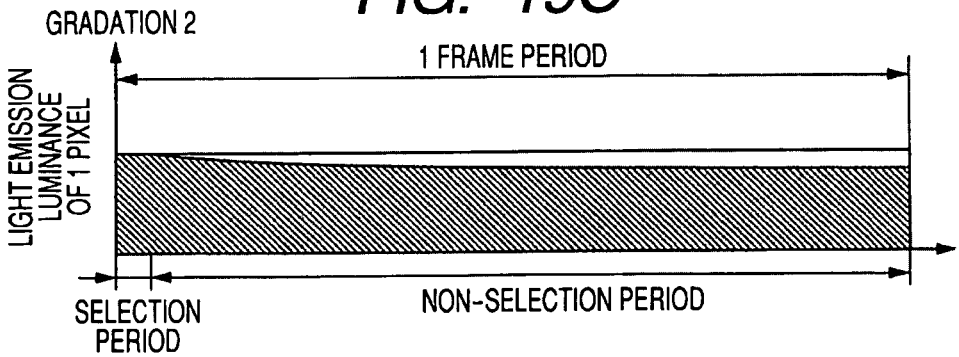
Figure 19D:
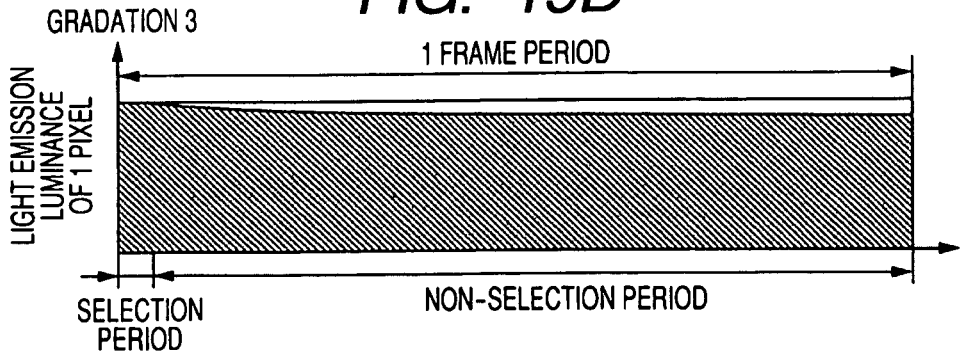
Figure 20:
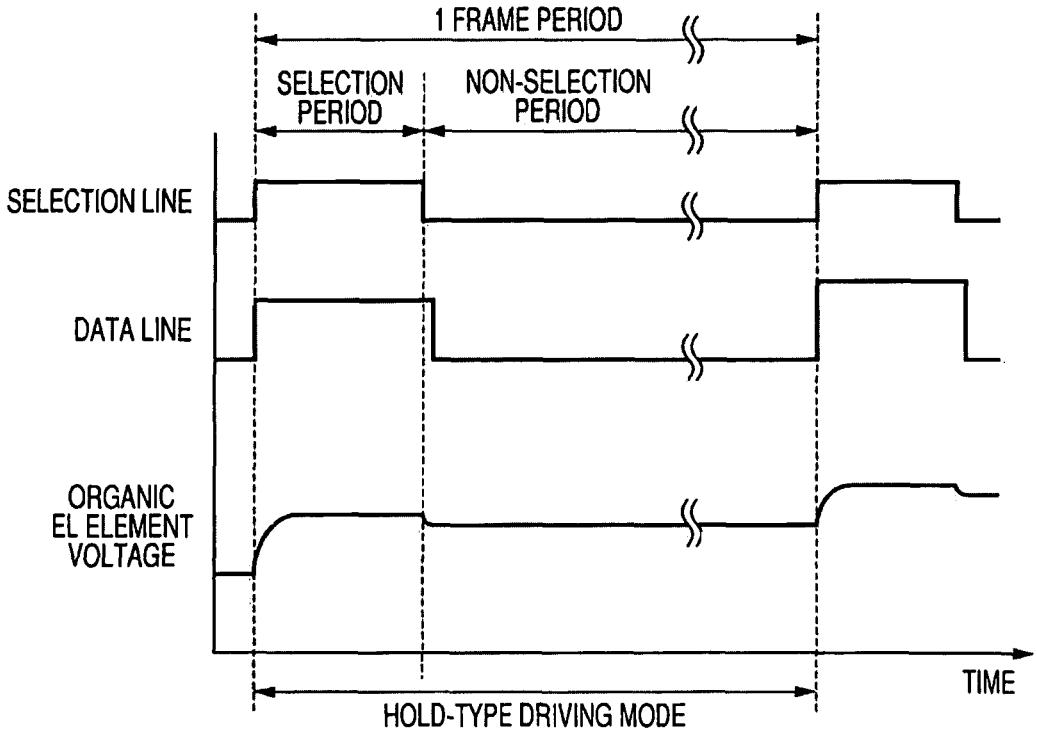
FIG. 20 is a timing chart of a driving method of a comparative example by the related background art.

FIG. 20 is a timing chart of a gradation control method according to the related background art in FIG. 15.

According to this timing chart, the gradation control is performed while maintaining the light emitting condition also in the non-selection period by modulating the voltage to be applied to an organic EL device 406 every gradation and holding a predetermined voltage in a storage capacitor 407.

Therefore, as the gradation control method, the hold-type driving voltage in the hold-type driving mode is only set, and in a case that the hold-type driving voltage is modulated with 12-bit scale as in the above-mentioned embodiment, the gradation number is also remained in 12 bits as it is and the monochromatic 24-bit gradation control can not be performed.

[Embodiment 2]

Next, the second embodiment of the present invention will be described with reference to FIGS. 8 to 12C. The system constitution in the present embodiment is same as that in the first embodiment indicated in FIG. 3.

Figure 8:
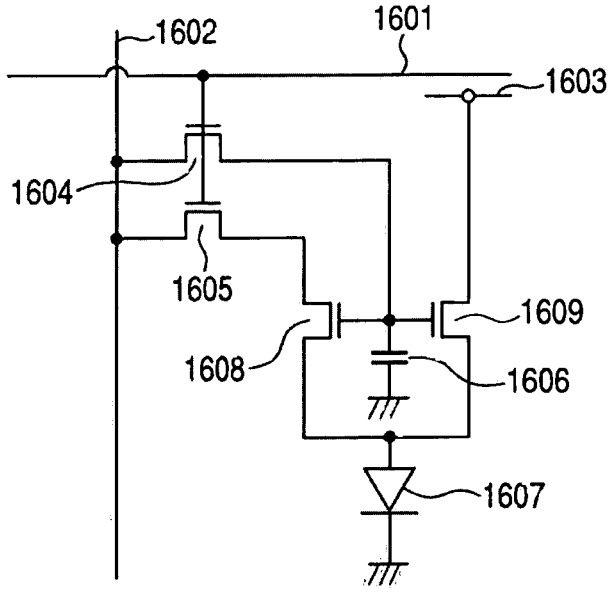
FIG. 8 is a circuit diagram indicating the constitution of a pixel circuit of an active matrix organic EL display according to the second embodiment of the present invention.

FIG. 8 is a view indicating detail of a pixel circuit in one sub pixel within the display panel 1001 indicated in FIG. 3.

The pixel circuit indicated in FIG. 8 is connected with a selection line 1601, a data line 1602 and a voltage supply line 1603. The selection line 1601 is connected with the gate driver 1003 indicated in FIG. 3. The voltage supply line 1603, which is connected with the power supply circuit 1005 through the source driver 1002 indicated in FIG. 3, supplies a constant voltage to the pixel circuit. Furthermore, the data line 1602, which is connected with the source driver 1002, transmits a data signal from the source driver 1002 to the pixel circuit.

This pixel circuit has a first switching TFT 1604 and a second switching TFT 1605 which are transistors of constituting the switching device, a storage capacitor 1606, an organic EL device 1607, a mirror TFT 1608 and a driving TFT 1609. The mirror TFT 1608 and the driving TFT 1609 constitute a transistor which forms a pair with a current mirror circuit.

With respect to the first switching TFT 1604, a gate electrode is connected with the selection line 1601, a drain electrode is connected with the data line 1602 and a source electrode is connected with a gate electrode of the driving TFT 1609, a gate electrode of the mirror TFT 1608 and the storage capacitor 1606 respectively. With respect to the second switching TFT 1605, a gate electrode is connected with the selection line 1601, a drain electrode is connected with the data line 1602 and a source electrode is connected with a drain electrode of the mirror TFT 1608 respectively.

With respect to the mirror TFT 1608, the gate electrode is connected with the source electrode of the first switching TFT 1604, a source electrode is connected with an anode electrode of the organic EL device 1607 and the drain electrode is connected with the source electrode of the second switching TFT 1605 respectively. With respect to the driving TFT 1609, a gate electrode is connected with the source electrode of the first switching TFT 1604, a drain electrode is connected with the voltage supply line 1603 and a source electrode is, similar to the mirror TFT 1608, connected with the anode electrode of the organic EL device 1607 respectively.

The first switching TFT 1604 is a switch for connecting the storage capacitor 1606 and the gate electrode of the driving TFT 1609 with the data line 1602. When a selection signal is entered into the selection line 1601, the first switching TFT 1604 becomes an ON state and a predetermined voltage is set to the storage capacitor 1606. After the selection period is terminated, a current is supplied to the organic EL device 1607 to emit the light. This period corresponds to the hold-type driving mode. The second switching TFT 1605 connects the mirror TFT 1608 with the data line 1602, which is connected with the organic EL device through 1607 through the mirror TFT 1608. When the selection signal is entered into the selection line 1601, the second switching TFT 1605 becomes an ON state and the current flows into the organic EL device 1607 from the data line 1602 through the mirror TFT 1608 to drive the organic EL device 1607. This period corresponds to the impulse-type driving mode.

Figure 9:
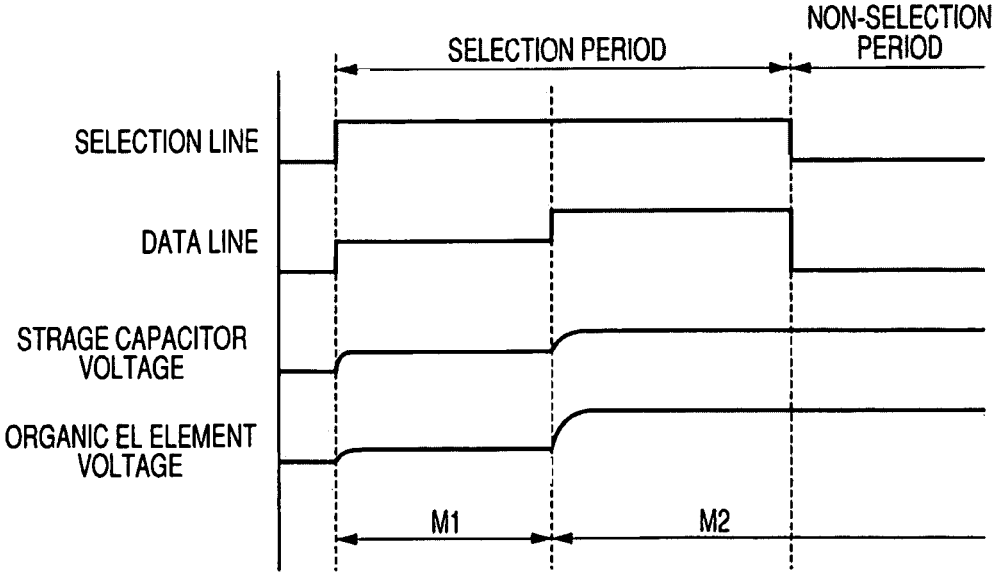
FIG. 9 is a timing chart of a driving method of the active matrix organic EL display according to the second embodiment of the present invention.

FIG. 9 is a timing chart of a driving method of the present embodiment. The voltages of the selection line 1601, the data line 1602, the storage capacitor 1606 and a sub-pixel of the organic EL device 1607 in the selection period are respectively indicated in FIG. 9. In a timing chart of this driving method, a gradation program is performed by continuously giving two steps (modes) of the impulse-type driving mode M1 and the hold-type driving mode M2 within the selection period.

First, the voltage of the selection line 1601 is set to a high level in a period of the impulse-type driving mode M1 within the selection period, and the first switching TFT 1604 and the second switching TFT 1605 are set to an ON state. At this time, the impulse-type driving voltage, which is used to cause the organic EL device 1607 to emit the light with the desired luminance, is set for the data line 1602. The set impulse-type driving voltage is applied to the organic EL device 1607 only a period of the impulse-type driving mode.

Next, in a program period of the hold-type driving mode M2 within the selection mode, a gate voltage used for driving the driving TFT 1609 is set for the data line 1602. Since the set voltage is held in the storage capacitor 1606, the hold-type driving voltage is maintained in the organic EL device 1607 not only in the program period of the hold-type driving mode M2 but also in a non-selection period when the first switching TFT 1604 becomes an OFF state.

Figure 10:
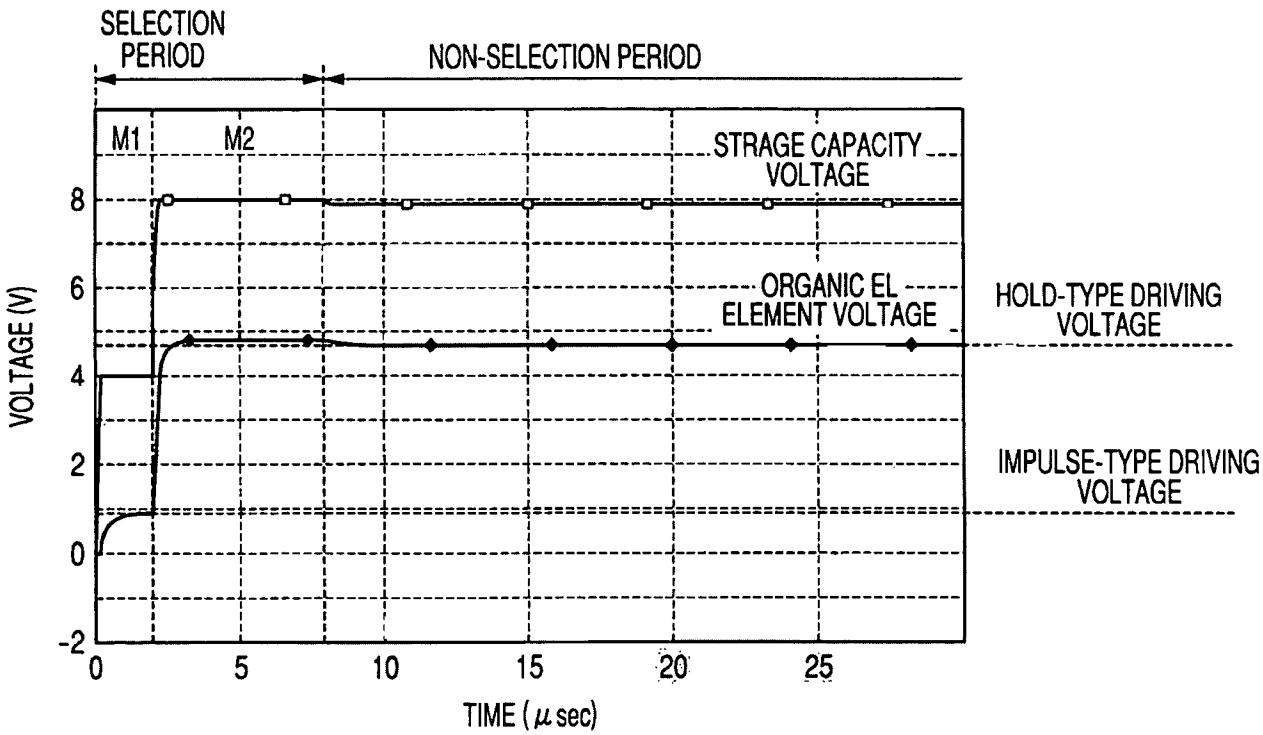
FIG. 10 is a view indicating an SPICE (Simulation Program with Integrated Circuit Emphasis) simulation result of a driving method of the active matrix organic EL display according to the second embodiment of the present invention.

FIG. 10 is a view indicating a result of an SPICE simulation, which was performed by the above-mentioned constituted pixel circuit and the driving method according to the timing chart. In this simulation, a selection period was set as a period for 7.7 μsec, and a period of the impulse-type driving mode M1 was set for 2 μsec and a program period of the hold-type driving mode M2 was set for 5.7 μsec. Both a turn-on time and a turn-off time of a signal of the selection line 1601 are set for 0.1 μsec.

As a result of this simulation, the voltage of the organic EL device was set to the impulse-type driving voltage in the period of the impulse-type driving mode M1. And, in the program period of the hold-type driving mode M2, the voltage of the storage capacitor was set and the hold-type driving voltage was set to the organic EL device. From a result of this simulation, it was understood that all steps (modes) were terminated at a high speed within the selection period.

Figure 11:
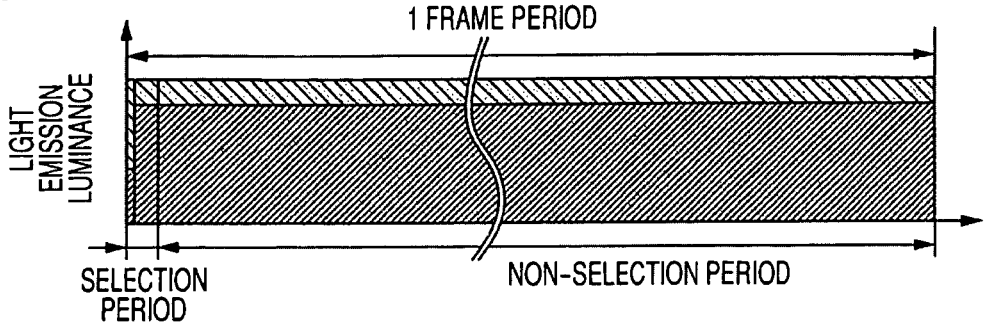
FIG. 11 is a schematic view indicating the light emitting condition of one sub pixel during one frame period of the active matrix organic EL display according to the second embodiment of the present invention.

A schematic view of indicating the light emission condition of one sub pixel within one frame period according to the present embodiment is indicated in FIG. 11.

From a result of the above-mentioned simulation, it was confirmed that the light is emitted with the light emission luminance corresponding to the impulse-type driving voltage in the period of the impulse-type driving mode M1 within the selection period. In addition, it was confirmed that the light is emitted with the light emission luminance corresponding to the hold-type driving voltage in the program period of the hold-type driving mode M2 within the selection period and in a non-selection period.

In the present embodiment, the impulse-type driving voltage and the hold-type driving voltage are individually set, and the set voltages were used for the gradation control similar to the above-mentioned first embodiment. That is, amplitude values of the impulse-type driving voltage and the hold-type driving voltage are respectively divided into 12-bit data equivalent to 4096 steps.

Figure 12A:
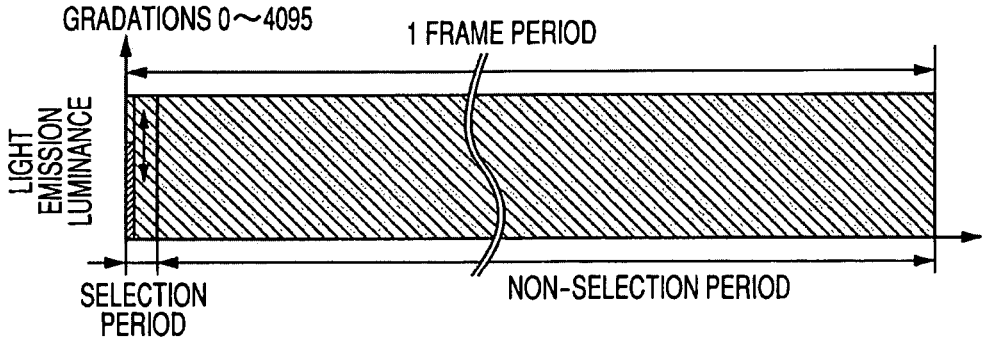
FIGS. 12A, 12B and 12C are views schematically indicating the light emission luminance of a sub pixel when controlling the gradation of the active matrix organic EL display according to the second embodiment of the present invention.
Figure 12B:
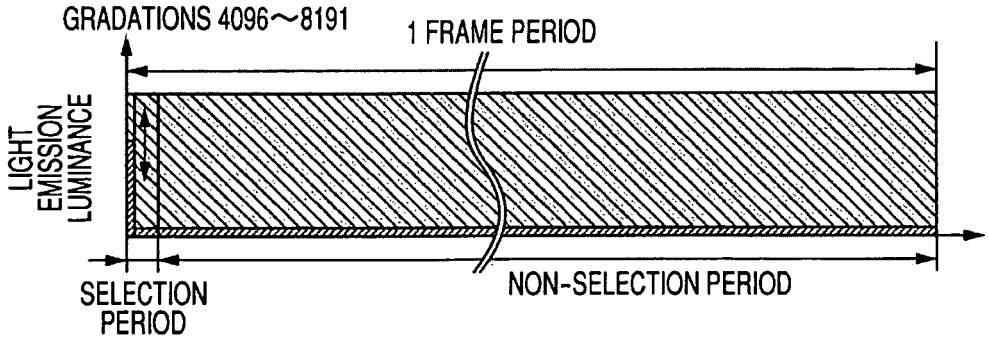
Figure 12C:
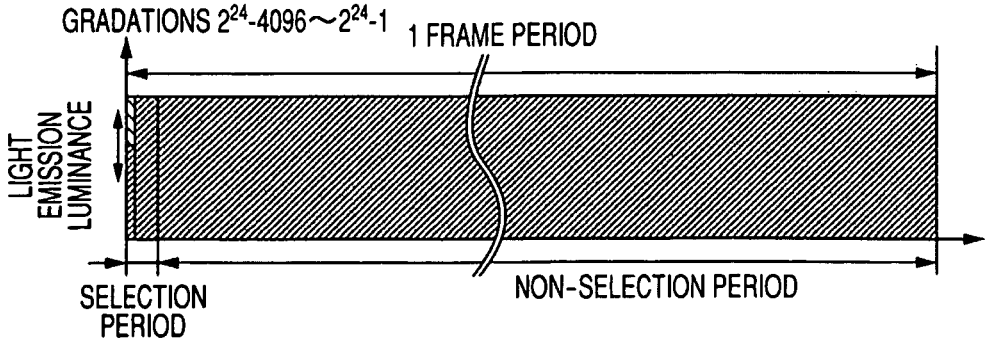
Figure 13:
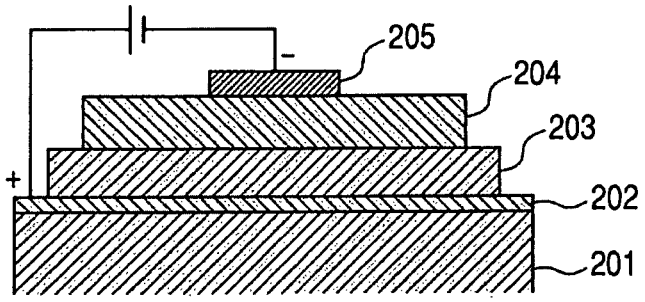
FIG. 13 is a view indicating the structure of a conventional organic EL device.
Figure 14:
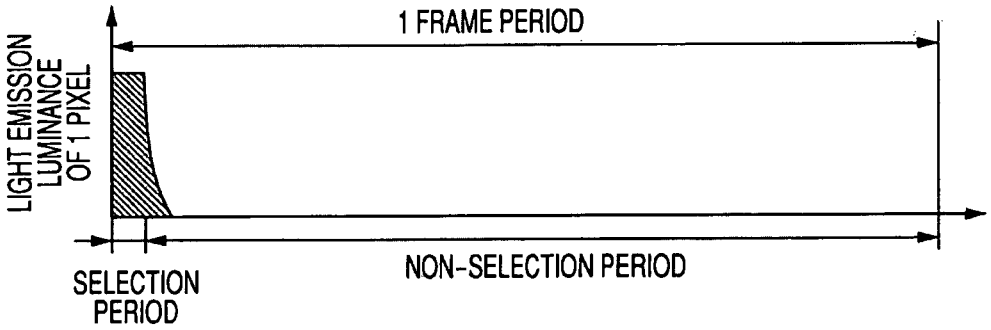
FIG. 14 is a view indicating the light emission luminance during one frame period in a conventional passive matrix system.

FIGS. 12A to 12C schematically indicate the light emission luminance of a sub pixel when the 24-bit gradation control was performed.

As indicated in FIG. 12A, the hold-type driving voltage is set to such the voltage, by which the organic EL device does not emit the light at gradations of 0 to 4095, and the 12-bit amplitude modulation is performed to only the impulse-type driving voltage.

As indicated in FIG. 12B, at gradation of 4096, the hold-type driving voltage is set to such the voltage of generating the light emission luminance corresponding to 1/4096-step of gradation and the impulse-type driving voltage is set to such the voltage, by which the organic EL device does not emit the light. And, at gradations of 4096 to 8191, the amplitude modulation is performed to the impulse-type driving voltage while setting the hold-type driving voltage to such the voltage of generating the light emission luminance corresponding to 1/4096-step of gradation.

In this manner, every time when an amplitude value of the impulse-type driving voltage becomes the maximum amplitude value, the hold-type driving voltage is raised one step by one step every the voltage of generating the light emission luminance corresponding to 1/4096-step of gradation. And, as indicated in FIG. 12C, finally, at gradations of $2^{24}-4096$ to $2^{24}-1$, the amplitude modulation is performed to the impulse-type driving voltage by setting the amplitude value of the hold-type driving voltage as the maximum amplitude value. In other words, the least significant bit (LSB) of the gradation is set by the impulse-type driving voltage and the upper bit is controlled by the hold-type driving voltage.

In the present embodiment, since a display screen is driven under the condition that the number of scan lines is 1080 lines and the frame transmission speed is 120 frames/sec, in a case that the hold-type driving voltage is set to such the voltage of generating the light emission luminance (the minimum light emission luminance) corresponding to 1/4096-step of gradation, the cumulative luminance in a case that the light is made to be emitted by the maximum amplitude voltage in the impulse-type driving mode becomes similar to that of the hold-type driving mode. That is, if the maximum light emission luminance is assumed as 410 cd/m$^2$, the cumulative luminance of the maximum light emission luminance in one frame period of the impulse-type driving mode is 410 cd/m$^2$×2 μsec=820 cd·μμsec/m$^2$. On the other hand, in the hold-type driving mode, since the luminance of 0.1 cd/m$^2$ corresponding to 1/4096-step of gradation is set and the light is emitted for 8.2 msec in one frame period, the cumulative luminance of the minimum light emission luminance in the one frame period becomes 0.1 cd/m$^2$×8200 μsec=820 cd·μμsec/m$^2$.

As described above in detail, if the pixel circuit and the driver of the present embodiment are used, a monochromatic 24-bit gradation control can be performed without requiring the high speed driving of the driver as in the conventional art or a high output of reducing an operating life of the organic EL device.

In the present embodiment, a pixel circuit can be simplified by commonly using a selection line of controlling the impulse-type driving mode and the hold-type driving mode. Additionally, in the present embodiment, since the impulse-type driving mode and the hold-type driving mode can be controlled by the constitution of the current mirror, not only a voltage program for designating the luminance by the voltage but also a current program for designating the luminance by a current value can be utilized.

(Another Embodiment)

1) In the first and second embodiments (FIGS. 4 and 8), although the switching device in the pixel circuit is constituted by two TFTs, the present invention is not limited to this constitution, and if the switching device is constituted by at least one TFT, such the switching device is applicable. In this case, both an n-type TFT and a p-type TFT are applicable.

2) In the first and second embodiments (FIGS. 4 and 8), although the storage capacitor in the pixel circuit is constituted by one capacitor, the present invention is not limited to this constitution, and if the storage capacitor is constituted by at least one capacitor, such the storage capacitor is applicable.

3) In the first and second embodiments (FIGS. 4 and 8), although the organic EL device in the pixel circuit is constituted by one device, the present invention is not limited to this constitution, and if the organic EL device is constituted by at least one device, such the organic EL device is applicable.

4) In the first embodiment (FIG. 4), although the driver transistor in the pixel circuit is constituted by one TFT, the present invention is not limited to this constitution, and if the driver transistor is constituted by at least one TFT, such the driver transistor is applicable. In this case, both an n-type TFT and a p-type TFT are applicable.

5) In the second embodiment (FIG. 8), although the current mirror in the pixel circuit is constituted by two TFTs, the present invention is not limited to this constitution, and if the current mirror is constituted with transistors which form a pair with the current mirror, such the current mirror is applicable, and it is allowed to be constituted by at least two TFTs. In this case, both an n-type TFT and a p-type TFT are applicable.

While the present invention has been described with reference to the exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-172457, filed Jun. 29, 2007 which is hereby incorporated by reference herein in its entirety.

What is claimed is:

1. An active matrix organic electroluminescence display comprising:

a plurality of selection lines and a plurality of data lines which are mutually crossed; and a plurality of pixel circuits, each of which is connected to one of the plurality of selection lines and one of the plurality of data lines and includes a driving transistor, switching devices, a storage capacitor and an organic electroluminescence device, wherein a frame period is constituted by a selection period in which a selection signal is applied to the selection line to which the pixel circuit is connected and a non-selection period in which the selection signal is not applied to the selection line to which the pixel circuit is connected, wherein the selection period includes a first part and a second part, wherein in the first part of the selection period, a first data signal is supplied through the data line to the selected pixel circuit and held as a voltage at the storage capacitor of the selected pixel circuit, wherein in the first part of the selection period and a part or all of the non-Selection period, a first current according to the voltage held at the storage capacitor is supplied to the organic electroluminescence device so that the organic electroluminescence device emits light at luminance according to the first current, wherein in the second part of the selection period, a second current according to a second data signal is supplied through the data line to the organic electroluminescence device of the selected pixel circuit so that the organic electroluminescence device of the selected pixel circuit emits light at luminance according to the second current, and wherein luminance according to the first current is cumulated in the frame period to represent one of the discrete gradation levels corresponding to the first data signal and luminance according to the second current is cumulated in the frame period to represent gradation between steps of the discrete gradation levels corresponding to the second data signal.

2. The active matrix organic electroluminescence display according to claim 1, wherein a maximum luminance corresponding to the second data signal cumulated in the frame period is equal to a step of gradation represented by the first data signal.

3. The active matrix organic electroluminescence display according to claim 2, wherein the first data signal is the gradation signal produced from a digital signal, and the second data signal is a continuous gradation signal.

4. The active matrix organic electroluminescence display according to claim 1, wherein the storage capacitor and the driving transistor in the pixel are connected to the data line through a first switching device, and the organic electroluminescence device is connected to the data line through a second switching device.

5. The active matrix organic electroluminescence display according to claim 1, wherein the storage capacitor and the driving transistor in the pixel are connected to the data line through a first switching device, and the organic electroluminescence device is connected to the data line through a second switching device and a transistor constituting a current mirror circuit with the driving transistor.

6. The active matrix organic electroluminescence display according to claim 1, wherein the second data signal is applied to the plural data lines before the first data signal is applied.

7. The active matrix organic electroluminescence display according to claim 1, wherein the first data signal and the second data signal are successively applied to the plural data lines.

8. The active matrix organic electroluminescence display according to claim 1, wherein, before the first data signal and the second data signals are supplied to the selected pixel circuit, a signal for resetting the voltage held at the storage capacitor is applied to the plural data lines.

9. The active matrix organic electroluminescence display according to claim 1, wherein the switching element is a thin film transistor which is constituted by amorphous silicon or an oxide semiconductor.

* * * * *